US005944026A

United States Patent [19]

Kopsch et al.

[11] Patent Number: 5,944,026

[45] Date of Patent: Aug. 31, 1999

[54] TOBACCO PRODUCTS OR MATERIALS RESEMBLING TOBACCO PRODUCTS CONTAINING NATURAL SUBSTANCES HAVING AN ANTIOXIDATIVE EFFECT AND PROCESSES FOR THE PREPARATION THEREOF

[75] Inventors: Reiner Kopsch, Schenefeld; Wolfram Roeper, Hamburg; Wolfgang Wildenau, Bargfeld-Stegen, all of Germany

[73] Assignee: H.F. & Ph.F. Reemtsma GmbH & Co., Hamburg, Germany

[21] Appl. No.: 08/727,411

[22] PCT Filed: Apr. 18, 1995

[86] PCT No.: PCT/EP95/01452

§ 371 Date: Oct. 17, 1996

§ 102(e) Date: Oct. 17, 1996

[87] PCT Pub. No.: WO95/28098

PCT Pub. Date: Oct. 26, 1995

[30] Foreign Application Priority Data

Apr. 19, 1994 [DE] Germany ..... 44 16 101

[51] Int. Cl.[6] ..... A24B 3/18

[52] U.S. Cl. ..... 131/359; 31/291

[58] Field of Search ..... 131/359, 291; 526/314; 424/195.1

[56] References Cited

U.S. PATENT DOCUMENTS 4,516,588 5/1985 Rudolf et al. ..... 131/291

FOREIGN PATENT DOCUMENTS

| | | |
|---|---|---|
| 0110693A1 | 6/1984 | European Pat. Off. . |
| 62-014772 | 1/1987 | Japan . |
| 5023159 | 2/1993 | Japan . |
| WO 88/08700 | 11/1988 | WIPO . |
| WO 94/00138 | 1/1994 | WIPO . |
| WO 95/28098 | 10/1995 | WIPO . |

OTHER PUBLICATIONS

Leffingwell et al. "Tobacco Flavoring For Smoking Products" R. J. Reynolds Tobacco Company, NC, 1972.

*Primary Examiner*—Mickey Yu
*Assistant Examiner*—Kelly O'Hara
*Attorney, Agent, or Firm*—Foley & Lardner

[57] ABSTRACT

Smokable products made of tobacco and/or another smokable material, which comprise natural substances having an antioxidative effect and/or naturally identical synthetic products thereof. These natural substances are selected according to the invention from hydroxycinnamic acids and their esters and depsides, plant phenols which can be derived from hydroxycinnamic acids, polymers of hydroxycinnamic alcohols, further natural substances of plant origin which have antimutagenic and aromatizing properties and are combined with vitamins, their precursors and/or derivatives having an antioxidative effect, and further vitamins having an antioxidative effect which are complexed with eukaryotic cell cultures. Processes for the preparation of products of this type are furthermore described. Compared with conventional smokable products, the products have a distinctly decreased risk potential.

21 Claims, 7 Drawing Sheets

Reduction of the mutagenicity of cigarette smoke condensate in the Ames test (TA 98) by addition of caffeic acid Reduction of the mutagenicity of cigarette smoke condensate in the Ames test (TA 98) by addition of chlorogenic acid Reduction of the mutagenicity of cigarette smoke condensate in the Ames test (TA 98) by addition of scopoletin Reduction of the mutagenicity of cigarette smoke condensate in the Ames test (TA 98) by addition of curcumin Reduction of the mutagenicity of cigarette smoke condensate in the Ames test (TA 98) by addition of eugenol Reduction of the mutagenicity of cigarette smoke condensate in the Ames test (TA 98) by addition of tocopherol/eugenol 1:1

Comparison of the mutagenic effect of the same amounts of smoke condensate of different experimental cigarettes

TOBACCO PRODUCTS OR MATERIALS RESEMBLING TOBACCO PRODUCTS CONTAINING NATURAL SUBSTANCES HAVING AN ANTIOXIDATIVE EFFECT AND PROCESSES FOR THE PREPARATION THEREOF

This application is based on International Application No. PCT/EP95/01452, filed Apr. 18, 1995, and is based on German Application No. P 44 16 101.8, filed Apr. 19, 1994; the present application claims priority from both prior applications.

FIELD Of INVENTION

The present invention relates to tobacco products or materials resembling tobacco products which are provided with natural substances known per se having an antioxidative effect and/or naturally identical synthetic products thereof and are intended for smoking, and to processes for the preparation of these products.

BACKGROUND OF THE INVENTION

The human body is exposed to a natural basic burden of toxic substances and is therefore confronted with a multiplicity of mutagenic and carcinogenic substances which, in the course of intrinsic metabolism, are even partly formed by the latter itself.

Man, however, has various defence mechanisms available on an immunological, cellular and genetic plane in order e.g. to counteract an allergic reaction, cell damage or a mutation event in the area of genetic information. Thus, in the cells, for example, so-called "repair systems" exist with whose aid changes in genetic material can be recognized and eliminated.

For a long time, it was assumed that there is a direct causal relationship between the action of possible risk factors such as e.g. various products of incomplete combustion, different radiations and/or electromagnetic fields, some plant protection agents and wood preservatives, certain mineral fibres (e.g. asbestos) and certain metabolic products of mould fungi (e.g. aflatoxin) on the human body and carcinogenesis. The fact that the majority of people who are exposed to these risk factors do not have the symptoms to be expected has led, however, to a rethinking in risk assessment. Thus the size of the cancer risk can no longer be defined on its own by the potential harmful substance or exposure factor. It must rather be assumed that it is the result of a multifactorial interrelationship between a multiplicity of substances/mechanisms which have an effect and the burdened body. It is further regarded as confirmed that several mutation events are necessary at certain sites in the genome in order that an abnormal cell having uncontrolled growth can be formed from a normal body cell.

Particular importance is ascribed to the body's own defence system, which can also be individually affected by the way of life. Thus, e.g. the absorption of food in the body initiates a number of chemical reactions in which substances having mutagenic and antimutagenic effects are in a close interrelationship with one another.

In the meantime, chemical compounds have been identified which have a protective action against substances having a mutagenic effect, such as e.g. different vitamins, mustard oils and beta-carotene. Naturally occurring plant phenols contained in foodstuffs, such as e.g. hydroxycinnamic acids and their compounds are also discussed as antimutagenic and anticarcinogenic substances of different intensity on account of their antioxidative properties (Karl Herrmann, "Hydroxyzimtsäure-Verbindungen als biologisch aktive Inhaltsstoffe von Lebensmitteln" [Hydroxycinnamic acid compounds as biologically active constituents of foodstuffs], Ernährungs-Umschau 38, No. 4, pp. 148–154 (1991)). These findings are supported, inter alia, by epidemiological results, which enable an inverse relationship to be detected between the consumption of fruit and vegetables and various carcinoses.

The term "tobacco products" used in this description is to be understood as meaning both cigarettes, cigarillos and tobacco cartridges (so-called tobacco-"rolls") with or without a filter and fine-cut and pipe tobacco, which consist entirely or proportionally of tobacco and/or another smokable material, and also smoking materials resembling tobacco products, such as, for example, "Kretek" cigarettes with addition of up to 50% by weight of smokable spices, or pure, tobacco-free plant cigarettes.

It is known that the consumers of smokable tobacco products also absorb a multiplicity of organic compounds, of which some have a toxic potential for the human body and others, on the other hand, can reduce this. In the discussion about the health-endangering properties of tobacco products, for a long time in particular the mutagenic and cancer-promoting action of some of the tobacco constituents passing into the human body by means of inhalation has been given prominence. As already mentioned, however, there is no direct causal relationship between the action of harmful substances and carcinogenesis.

Numerous series of experiments have led to the result that the substances or compounds present in a tobacco product and passing into the body of the consumer either in the gas or particulate phase of the mainstream smoke are not by direct means able to transform a normal cell of the human body into an abnormal cell.

It is therefore to be found that the mutagenic action detectable in laboratory experiments of constituents of the mainstream smoke of tobacco products cannot immediately be equated with a carcinogenic effect, as most substances and substance groups to be mentioned in this connection display their endangering potential only as a result of the cell's own metabolism of these compounds. These findings about the mutagenic action were obtained with the aid of the generally known Ames test (D. M. Maron and B. N. Ames, "Revised Methods for the Salmonella Mutagenicity Test", Handbook of Mutagenicity Test procedures, Elsevier Science Publishers BV, Ed. B. J. Kilbey, M. Legator, W. Nichols and C. Ramel, 1984).

Until now different routes have been taken to reduce the risk potential of smokable tobacco products.

On the one hand, new filter systems were provided by means of which certain groups of harmful substances are prevented from passing into the mainstream smoke and thus into the respiratory tract of the consumer. Thus, for example, DE Patent 35 32 618 discloses a doping of the filters of filter cigarettes with, for example, L-ascorbic acid, by means of which the reduction of aldehydes in the mainstream smoke of cigarettes should be significantly favoured. From WO 89/01301, it is known to prepare filters of filter cigarettes with micro- and macrocapsules containing ethanol and other alcohols in order to protect the lung tissue from certain toxic constituents of the cigarette smoke such as, in particular, nitrosamines by prior "blocking" of the affected or accessible areas with certain alcohols released in the mainstream smoke.

It has furthermore been attempted to impregnate the tobacco of filter cigarettes with certain substances in order even to reduce the content of certain harmful substances in the mainstream smoke. It is thus known from OE Patent 340 297 and OE Patent 240 298 to treat tobacco with ascorbic acid or with salts thereof in order to reduce the nitrogen dioxide content of the cigarette smoke. Furthermore, according to EP Patent 0 116 085, a process for the impregnation of filter cigarettes with interferon or biologically active fragments thereof was disclosed. Cigarettes treated in this way should activate the body's own production of interferon and thus assist the immune system.

Products prepared in this way indeed contribute to reducing potential risks of smoking, but they also comprise disadvantages inherent to the system. On the one hand, only certain toxic constituents mainly of the gas phase of the cigarette smoke are retained by means of chemisorption in the unburnt section of the cigarette rod ($NO_2$) or in the filter (aldehydes) while the content of other harmful substances in the mainstream smoke, however, is not affected. On the other hand, the production of a "protective layer" within the body according to WO 89/01301 should in turn only be successful against certain harmful substances such as, for example, the nitrosamines. The use of interferon according to EP Patent 0 116 085, however, is associated with considerable costs.

SUMMARY OF THE INVENTION

The object of the present invention is therefore in the provision of a further smoking material, which contains additives by means of which the potential risks of smoking are further decreased, and also in the provision of a process for the preparation of smoking materials of this type.

To achieve this object, a smokable product made of tobacco and/or another smokable material is proposed, which comprises natural substances and/or naturally identical synthetic products thereof having an antioxidative effect which are selected from:

(a) hydroxycinnamic acids, their esters and depsides;

(b) plant phenols which can be derived from hydroxycinnamic acids;

(c) polymers of hydroxycinnamic alcohols;

(d) combinations of further natural substances of plant origin, which have antimutagenic and aromatizing properties, with vitamins, their precursors and/or derivatives having an antioxidative effect;

(e) complexes of vitamins having an antioxidative effect with eukaryotic cell cultures.

DETAILED DESCRIPTION OF THE INVENTION

Figure 1:
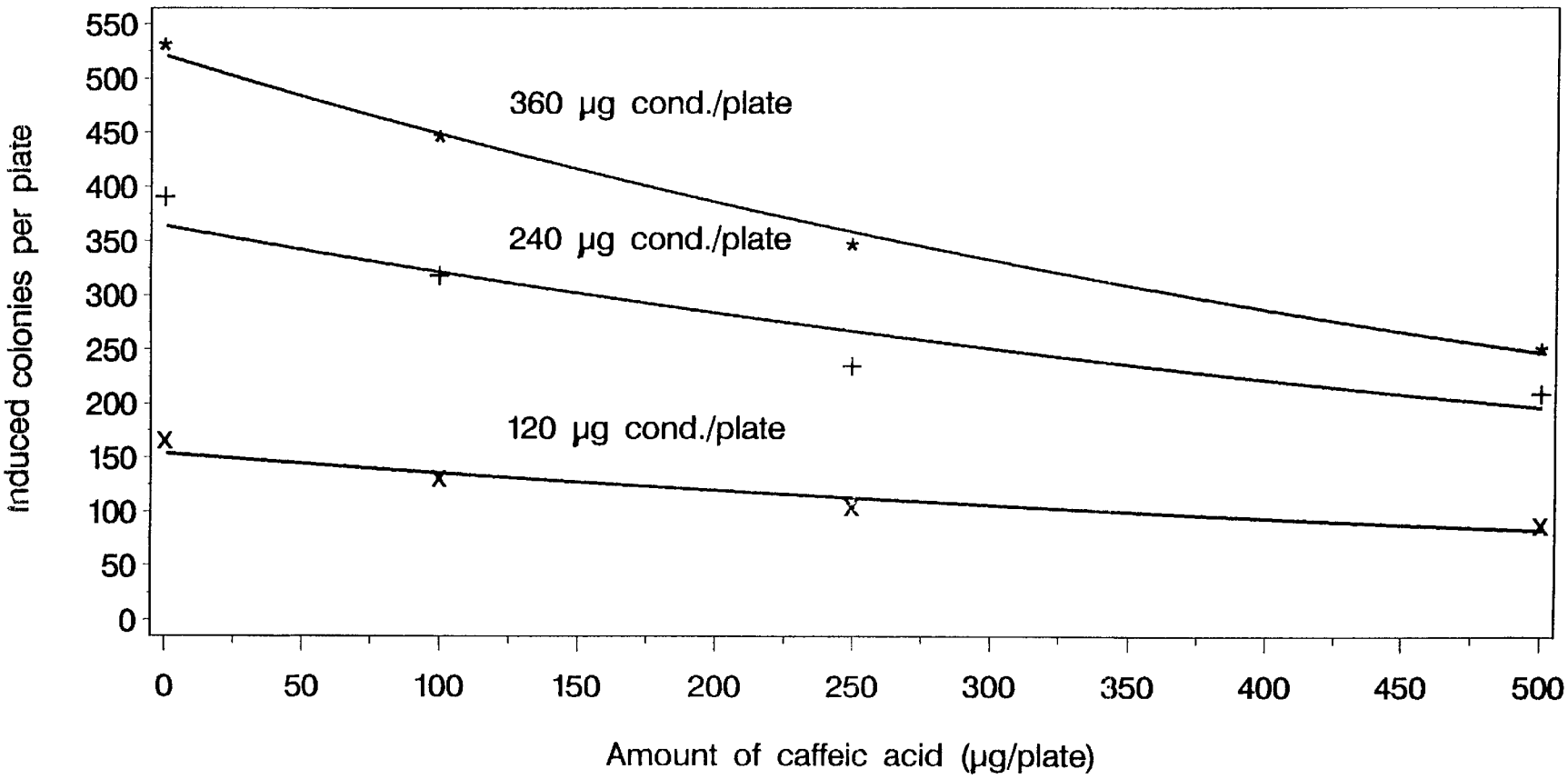
FIG. 1 is a graphical representation of the reduction of the mutagenicity of cigarette smoke condensate in the Ames test (TA98) by addition of caffeic acid.
Figure 2:
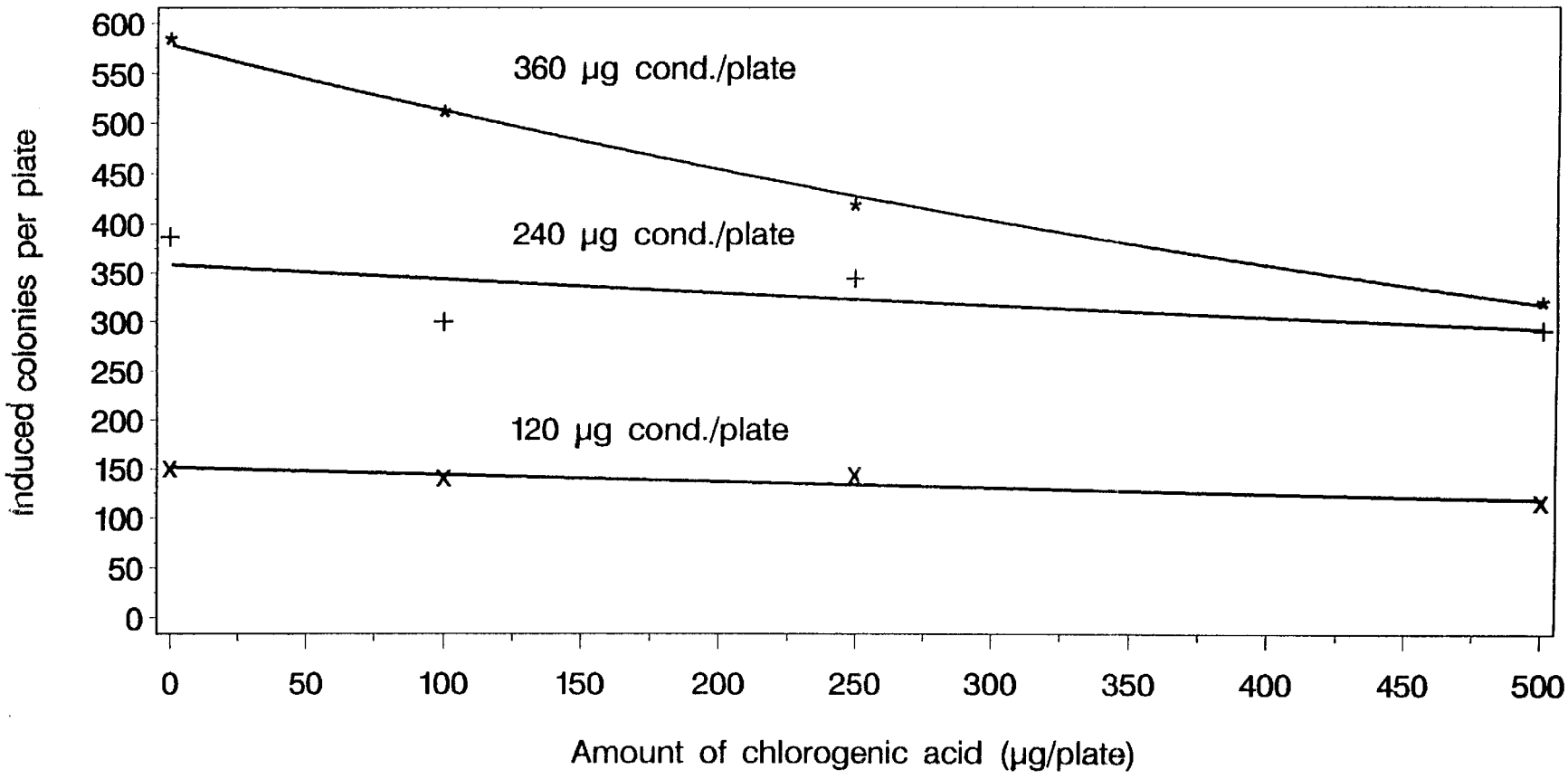
FIG. 2 is a graphical representation of the reduction of the mutagenicity of cigarette smoke condensate in the Ames test (TA98) by addition of chlorogenic acid.
Figure 3:
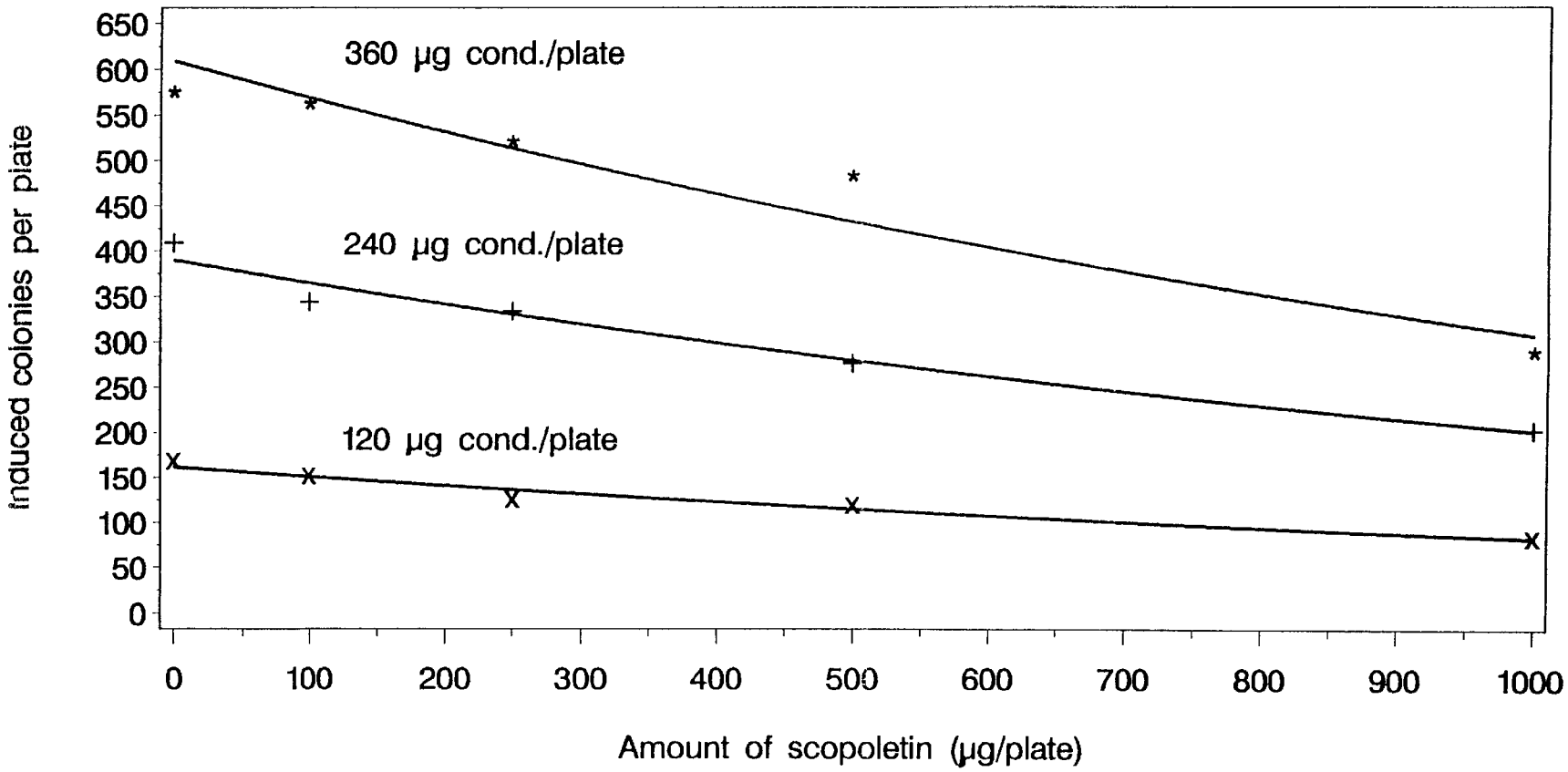
FIG. 3 is a graphical representation of the reduction of the mutagenicity of cigarette smoke condensate in the Ames test (TA98) by addition of scopoletin.
Figure 4:
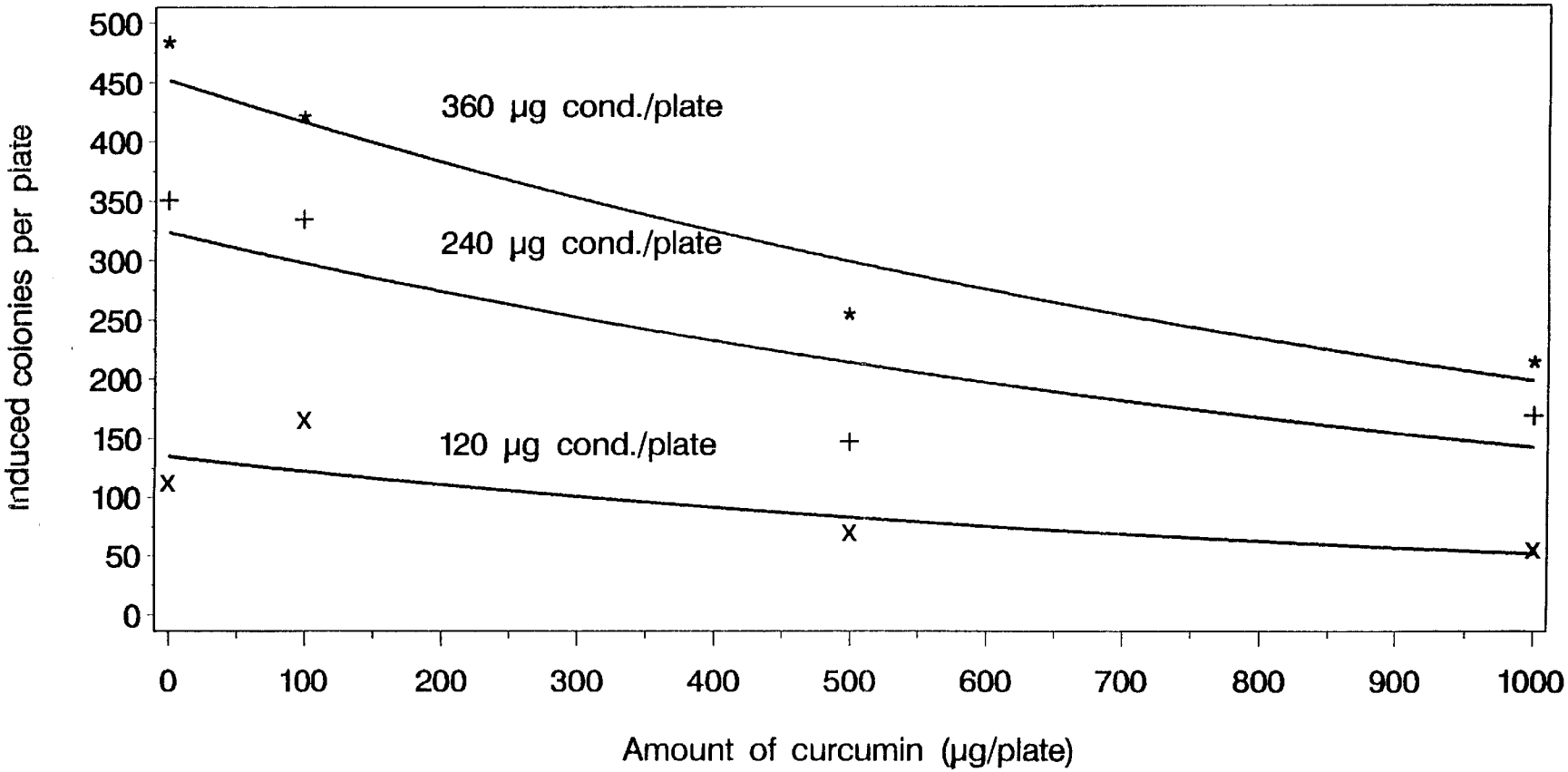
FIG. 4 is a graphical representation of the reduction of the mutagenicity of cigarette smoke condensate in the Ames test (TA98) by addition of curcumin.
Figure 5:
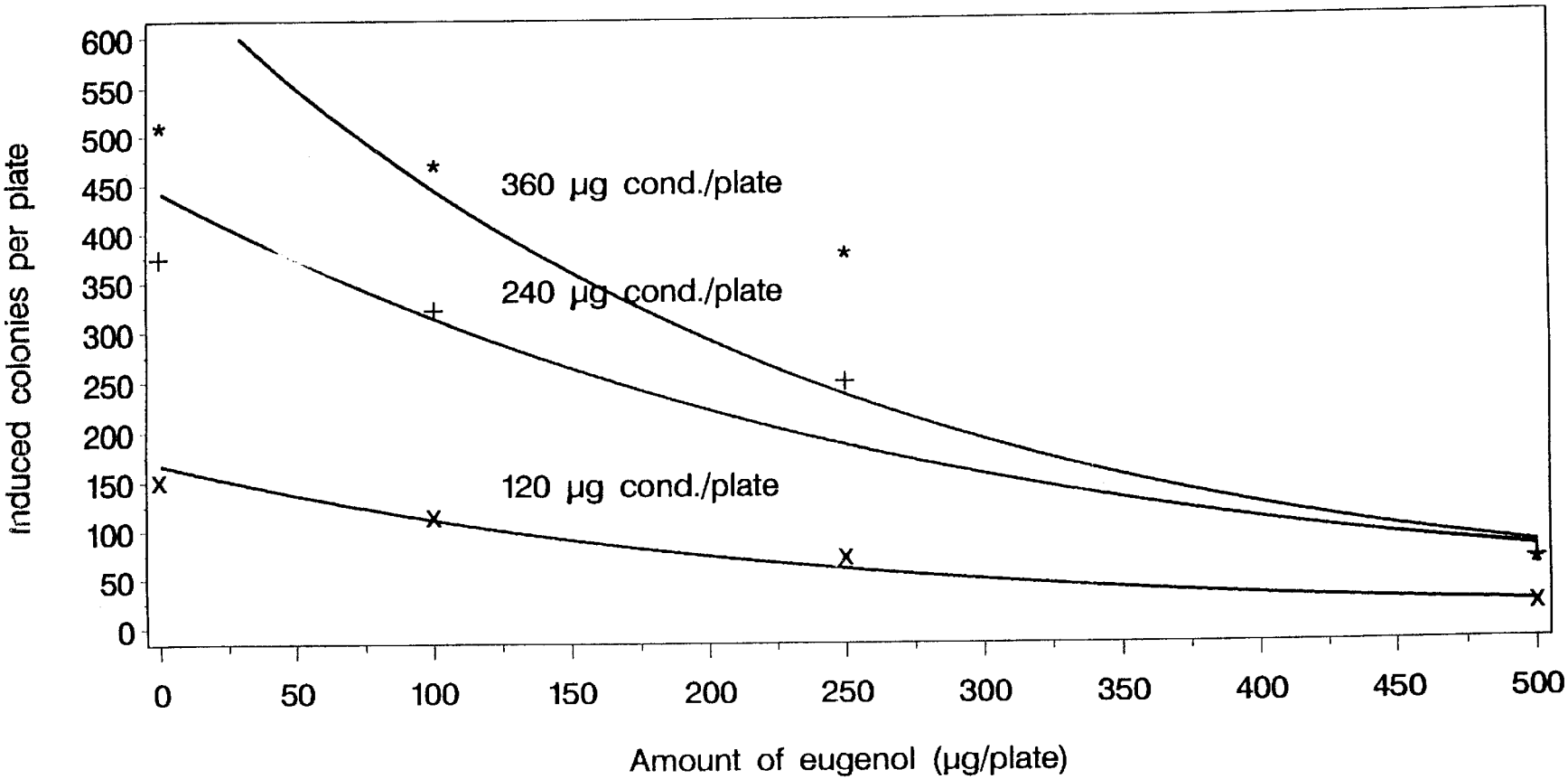
FIG. 5 is a graphical representation of the reduction of the mutagenicity of cigarette smoke condensate in the Ames test (TA98) by addition of eugenol.
Figure 6:
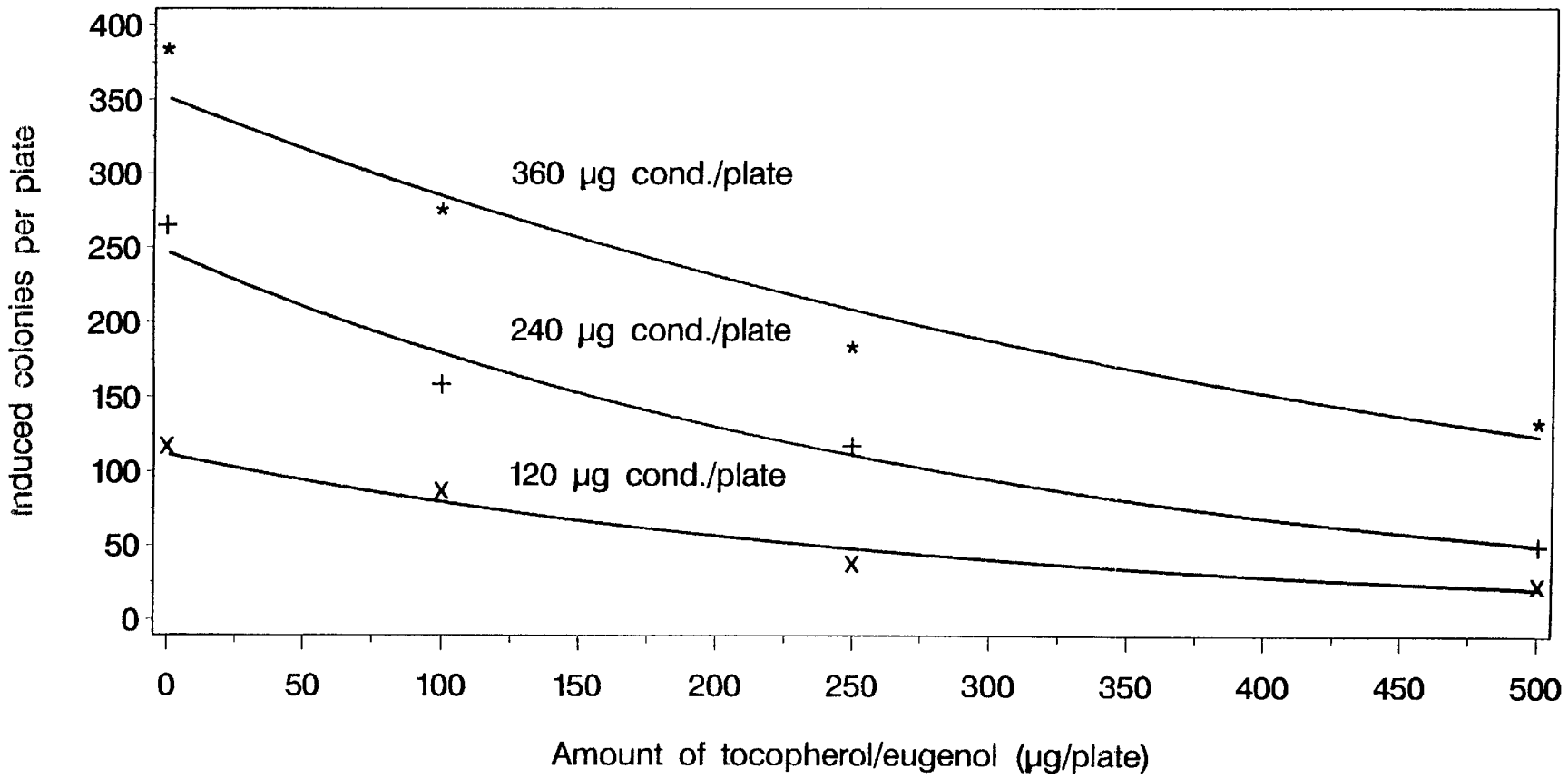
FIG. 6 is a graphical representation of the reduction of the mutagenicity of cigarette smoke condensate in the Ames test (TA98) by addition of tocopherol/eugenol (1:1).

It has surprisingly been found that the smokable product according to the invention has a distinctly decreased risk potential compared with conventional products.

The hydroxycinnamic acids p-coumaric acid, caffeic acid and ferulic acid are preferred in the tobacco product according to the invention. The preferred esters of the hydroxycinnamic acids are their methyl and ethyl esters, while the preferred depsides of the hydroxycinnamic acids consist of their compounds with fruit acids or quinic acid, of which chlorogenic acids are particularly preferred.

According to the invention, the preferred plant phenols which can be derived from hydroxycinnamic acids are umbelliferone, aesculetin, scopoletin, curcumin, ellagic acid and dihydrocaffeic acid, while the polymers of the hydroxycinnamic alcohols are preferably derived from p-coumaryl alcohol, coniferyl alcohol and sinapyl alcohol.

The further natural substances of plant origin having both antimutagenic and aromatizing properties are preferably vanillin, ethylvanillin, cinnamaldehyde, anisaldehyde, coumarin, 6-methylcoumarin, eugenol, jasmine aldehyde, anethole, p-anisylacetone, limonene, cinnamon and cinnamon extract. The vitamins having an antioxidative effect combined according to the invention with these other natural substances of plant origin are preferably ascorbic acid, β-carotene, retinol and α-tocopherol and also their derivatives, if appropriate in combination with one another and/or other vitamins. Stable derivatives of ascorbic acid such as ascorbic acid palmitate or ascorbigen (ascorbic acid bonded to indole) are particularly preferred. Other preferred vitamins which have an antioxidative effect and are complexed with eukaryotic cell cultures are β-carotene, retinol and α-tocopherol and also their derivatives.

The respective molecular weights and melting and boiling points of the natural substances of groups (a) to (d) according to the invention are listed in Table 1.

The preferred hydroxycinnamic alcohols according to the invention are p-coumaryl alcohol, coniferyl alcohol and sinapyl alcohol and form the lignin occurring in lignifying plants. The different hydroxycinnamic alcohols here are included in macromolecules in different linkage forms in varying quantitative amounts. The strength of the wood is essentially caused by the intercalation of lignin in cellulose.

It has been shown that in defibred wood the antioxidative phenolic properties of the lignin can become effective. Freshly prepared wood fibres, especially, are able to decrease the mutagenic potential of smoke passed over them.

According to a preferred embodiment, the natural substances and/or naturally identical synthetic products thereof having an antioxidative effect are contained in the tobacco product individually or in combination, it being possible for the relative amounts of them employed, based on the total weight, to vary depending on the intended target component (s) of a smokable tobacco product. Basically, the natural substances can be incorporated or finished both in the smoking tobacco including the customary additives and in components of the tobacco products individually accessible to the mainstream smoke, such as filters, wrapping papers, carriers, seam glue etc., in a manner known per se, which can take place both at the manufacturer of the tobacco product and proportionately at its supplier.

If the pure natural substances are added to the tobacco, the preferred relative amount of them used is in the range from 0.1 per thousand to 25% by weight, a content of between 1 and 5% by weight being particularly preferred. If the pure natural substances are incorporated in the filter or in the cigarette paper or in the glue of the cigarette seam, the preferred amounts are 0.1 to 50% by weight, amounts of 1 to 20% by weight being particularly preferred. The filter used can be a chamber filter, a cellulose acetate filter or a cellulose random fibre web filter or a multiple filter, preferably a double filter (in each case with or without filter ventilation), the double filter having a higher draw resistance on the rod side and a lower draw resistance on the mouth side and also a total filter efficiency of 80–99%. Filters made of other filter materials known per se can likewise be employed in combination with the natural substances having an antioxidative effect.

If the natural substances according to the invention are contained from the start in non-tobacco-containing, mainly plant, smokable materials, which are added to the tobacco, or alternatively the smokable mixture consists exclusively of optionally different non-tobacco-containing plant materials suited to each other with or without plant-endogenous natural substances according to the invention, the preferred amounts employed, to be related to the pure natural substances, of 0.1 per thousand to 25% by weight, as well as the particularly preferred amounts employed of 1.0 to 5% by weight, thus likewise apply, it being possible in all cases to make up the intended amount employed by addition of the pure natural substances or of the pure substances according to the invention to the smokable mixture. A further preferred use or supply form of the natural material containing the natural substances having an antioxidative effect, in particular vitamins such as α-tocopherol or β-carotene, are in this case cultured eukaryotic cells whose dry weight can contain between 0.5 and 15% by weight of the vitamins having an antioxidative effect in firmly bound or firmly combined form, such as, for example, specially cultured tobacco or yeast cells.

Thus it is possible according to processes known per se (e.g. W. Röper et al., J. Plant Physiol. 118, 463–470 (1985) and DE Patent 2 144 460) to culture tobacco cells in liquid culture substrates to prepare a tobacco substitute material.

In the context of the present invention, it has surprisingly been shown that the antioxidative natural substances according to the invention combine firmly with the cultured eukaryotic cells if they are added to the culture broth in suitable concentrations. For example, the concentrations in the case of α-tocopherol (in the form of α-tocopherol acetate) are 0.01 to 10, preferably 0.05 to 2% by volume, and in the case of β-carotene 0.01 to 0.5, preferably 0.05 to 0.2 per thousand by volume. The complexes according to the invention thus formed can then be added, after filtration from the culture broth and drying, to the smokable mixture.

TABLE 1

Phenolic plant constituents according to the invention

| Constituent | MW | B.p. (° C.) | M.p. (° C.) |
|---|---|---|---|
| p-Coumaric acid | 164.2 | sublimes | 214–217 (dec.) |
| Methyl p-coumarate | 178.2 | | 139 |
| Ethyl p-coumarate | 192.2 | | 87 |
| Caffeic acid | 180.2 | | 215–220 (dec.) |
| Methyl caffeate | 194.2 | | 157–158 |
| Ethyl caffeate | 208.2 | | 149–150 |
| Ferulic acid | 194.2 | | 170–172 |
| Methyl ferulate | 208.2 | 163 at 1 mm Hg | 65 |
| Ethyl ferulate | 222.2 | 185 at 3 mm Hg | 58 |
| Chlorogenic acid | 354.3 | | 208–210 (dec.) |
| Umbelliferone | 162.2 | sublimes | 230–233 |
| Aesculetin | 178.2 | sublimes | 272–275 (dec.) |
| Scopoletin | 192.2 | | 204–206 |
| Curcumin | 368.4 | | 175–180 |
| Ellagic acid | 302.2 | | >350 |
| Dihydrocaffeic acid | 182.2 | | 133–137 |
| Vanillin | 152.2 | 170 at 15 mm Hg | 81–83 |
| Ethylvanillin | 166.2 | | 74–77 |
| Cinnamaldehyde | 132.2 | 253 | −7.5 |
| Anisaldehyde | 136.2 | 248 | 2.5 |
| Coumarin | 146.2 | 297–299 | 68–71 |
| 6-Methylcoumarin | 160.2 | 303 | 75–76 |
| Eugenol | 164.2 | 253–255 | −9 |
| Jasminealdehyde | 202.3 | 287–290 | — |
| Anethole | 148.2 | 232–237 | 20–23 |
| p-Anisylacetone | 178.2 | 152–153 at 15 mm Hg | 8 |
| Limonene | 136.2 | 176 | −97 |

For example, the substances according to the invention can be added to the cut leaves and/or the cut stems in a manner known per se when preparing a smokable mixture, optionally using known adhesives and binding agents. Alternatively, the substances can be incorporated in a known manner in reconstituted tobacco, which suggests itself, in particular, when using solid, ground natural substances. A novel, non-tobacco-containing reconstituted plant can also be employed here which at least proportionally contains the natural substances according to the invention in the form of plant-endogenous constituents of parts of the reconstituted plant material. Preferably, the smokable base material is a mixture of lamina tobaccos or a mixture of lamina tobacco and reconstituted tobacco or a tobacco-free mixture of plant material which is derived from coltsfoot, peppermint, stinging nettle, ripple-seed plantain, crispleaf mint, lavender, thyme, sweet or sour cherry leaves, knotweed leaves, rose leaves, pimento leaves or cinnamon bark. Alternatively, it is preferred that the smokable mixture is a combination of tobacco mixture and tobacco-free mixture.

The substances according to the invention can furthermore be added to the casings and/or flavourings in liquid form, it even being possible for them to replace these.

The customary filter systems consist essentially either of a filter fibre tow made of cellulose acetate fibres or of cellulose fibres entangled with one another, which yield a random cellulose fibre web. The filter fibre tow is normally sprayed during the preparation of the cigarette filter with one of the permissible hardeners in order to crosslink the fibres and thus to harden the filter. These hardeners mostly consist of triacetin or triethylene glycol diacetate (TEGDA) and according to the invention can be partly or completely replaced by the natural substances according to the invention in liquid form if they dissolve in the hardener or else themselves act as a hardener, such as, for example, eugenol. In liquid natural substances such as eugenol which can be employed themselves according to the invention as hardeners, or in customary hardeners such as TEGDA or triacetin, according to the invention other natural substances such as cinnamaldehyde, jasmine aldehyde, ethylvanillin and 6-methylcoumarin, but also α-tocopherol, tocopherol acetate, tocopherol succinate, retinol and retinol palmitate can in turn be dissolved such that bi- or ternary or multiple solution mixtures result which can be employed advantageously both as hardeners for cellulose acetate fibres and as casing substances for smokable mixtures.

Furthermore, suspensions of solid natural substances can be employed in the hardener, but also interspersions of ground natural substances in filter fibre tow made of cellulose acetate fibres.

The different solubilities and miscibilities of some preferred aromatic substances and vitamins according to the invention in or with the customary hardener substances triacetin and TEGDA and also the natural aromatic substance eugenol which according to the invention can be used as the hardener substance itself are shown in Table 2. The excellent solubilizing properties of the eugenol which can be employed according to the invention as the hardener or hardener component can be seen, in particular, from the data in Table 2. The substance eugenol, however, can also be used in the form of a mixture with other substances mentioned as hardeners or solvents in Tables 2 and 3, where the actual mixtures and their respective proportions can easily be selected taking into account their properties and their market prices and also depending on the component(s) of the product according to the invention to be treated. A mixture of 80 parts of triacetin, 15 parts of eugenol and 5 parts of α-tocopherol acetate is particularly preferred. The substances mixed in this ratio yield a clear solution, from which, after application to cellulose acetate fibres, triacetin and eugenol preferably diffuse into the interior of the fibres, whereby the α-tocopherol acetate is concentrated on the surface of the filter fibres, and thus can be transferred particularly easily from the "filter", which here acts as an emitter, to the mainstream smoke.

If the filter to be used in the process for the preparation of a tobacco product does not consist of cellulose acetate fibres, it and/or the other components of the later product such as the smokable tobacco-containing or tobacco-free plant material, the cigarette paper and the seam glue to be used is treated according to the invention with a solution of the aromatic substances and vitamins (or provitamins) according to the invention, it being possible in turn to use individual representatives of these substance groups as solvents. The respective solubilities and miscibilities of all the substances in or with some of the natural substances which can also be employed as solvents according to the invention are shown in Table 3.

TABLE 2

Solubility of aromatic substances having an antioxidative effect and the vitamins A and E in filter hardeners

| | Aromatic substances | | | | Vitamins | | | | |
|---|---|---|---|---|---|---|---|---|---|
| Hardener | Cinnam-aldehyde | Jasmine-aldehyde | Ethyl-vanillin | 6-Methyl-coumarin | A | A Palmitate | E | E Acetate | E Succinate |
| Triacetin | M | M | >10 | >10 | >10 | <1 | >10 | <1 | <1 |
| TEGDA | M | M | >10 | >10 | >10 | <1 | M | <1 | <1 |
| Eugenol | M | M | >10 | >10 | >10 | <1 | M | M | 10 |

TEGDA = Triethylene glycol diacetate
M = miscible to equal parts
>10 = solubility greater than 10% by weight
<1 = solubility less than 1% by weight

TABLE 3

Solutions of aromatic substances having an antioxidative effect and the vitamins A and E and also β-carotene for the treatment of filters, tobacco, cigarette paper and seam glue

| | Aromatic substances | | | | | | Vitamins | | | |
|---|---|---|---|---|---|---|---|---|---|---|
| as a solvent | Eugenol | Jasmine-aldehyde | Cinnam-aldehyde | Ethyl-vanillin | 6-Methyl-coumarin | Provitamin β-carotene | A | E | E Acetate | E Succinate |
| Eugenol | x | M | M | >10 | >10 | <1 | >10 | M | M | >10 |
| Jasminealdehyde | M | x | M | >10 | >10 | <1 | >10 | M | M | >10 |
| Cinnamaldehyde | M | M | x | >10 | >10 | >1 | >10 | M | M | >10 |
| Vitamin E acetate | M | M | M | <1 | <1 | <1 | <1 | M | x | n.d. |

M = miscible to equal parts
>10 = solubility greater than 10% by weight
>1 = solubility greater than 1% by weight
<1 = solubility less than 1% by weight When using the cellulose random fibre web, the substances according to the invention can already be incorporated into the fibre web on the part of the filter material manufacturer. Finally, the customarily bleached cellulose fibres of, for example, one-year-old plants of the known random fibre web can be replaced here proportionally or predominantly, preferably up to 85%, by suitable unbleached wood pulp "fibres" containing sufficient lignin having an antioxidative effect. In addition, the solid substances according to the invention can be introduced into the chambers of chamber filters, for example in granulated form having a grain diameter of approximately 0.8 mm, on the part of the filter rod manufacturer, as well as liquid substances according to the invention, absorbed by, for example, wood meal or lignin granules, it being possible to employ particularly suitable wood particles or those containing much lignin having an antioxidative effect in fibre dust or granule form, solitarily as chamber intercalation materials or as self-supporting, porous or smoke-permeable pressings in the desired filter format. Furthermore, the inside of the filter wrapping paper coming into contact during smoking with the mainstream smoke can also be coated with the natural substances according to the invention.

The cigarette paper can be provided with the natural substances according to the invention in encapsulated or unencapsulated form in a manner known per se, both single- and two-layer cigarette papers being suitable for this purpose. In the latter case, the interior tobacco rod wrapping, which can also be designed to be net-like or highly porous (10–20,000 CORESTA), is preferably provided with the substances according to the invention. This net-like inner tobacco rod wrapping can be made mainly or entirely of suitable wood pulp containing lignin having an antioxidative effect, just as the fibre content of otherwise customary cigarette papers consists at least proportionally of suitable unbleached lignin-containing wood pulp.

Finally, the glue employed in the region of the cigarette seam for gumming the tobacco rod wrapping can also comprise the natural substances according to the invention in liquid or finely ground form. It has been shown here that the technical characteristics of glues treated in this way can even be improved.

According to the basic idea of the invention, on consuming or smoking the tobacco product according to the invention its mainstream smoke is enriched with the natural substances known per se having an antioxidative effect, whereby the antimutagenic substances released by the mainstream smoke are made available to the body at the site of metabolization by way of approximation at the same time as the potential harmful substances of the mainstream smoke and thus a possible mutagenic effect of the undesired critical substances is largely spontaneously compensated. This means that, with a comparatively small amount of substances having an antimutagenic effect, the same effect is produced as if a correspondingly larger amount of these substances was subsequently made available to the body.

An essential precondition for the practice-related use of the natural substances used according to the invention is their adequate passage into the mainstream smoke. Experimental findings have shown that this precondition is fulfilled by the natural substances employed (cf. Example 4). In addition, it has been shown that the passage into the mainstream smoke of natural substances according to the invention incorporated in plant parts—for example the tobacco leaf-endogenous scopoletin or the pimento leaf-endogenous eugenol—can be significantly favoured by the treatment of the corresponding plant parts by one of the known swelling or expansion processes, preferably by the so-called INCOM process of the applicant according to Patents DE 29 03 300, DE 31 19 330 and DE 34 14 625. In these processes relevant constituents of the plant parts are "made available", i.e. they can be transferred particularly easily by even only small amounts of mainstream smoke.

Surprisingly, it has been shown that it was possible to reduce the mutagenic potential of the enriched tobacco products according to the invention in a significant manner. To detect this antimutagenic action, the Ames test (loc.cit.) was carried out as a meaningful rapid test.

The test principle essentially consists in the fact that histidine-auxotrophic ($his^-$) indicator bacteria of the species *Salmonella typhimurium* backmutate into their prototrophic form ($his^+$) under the influence of substances having a mutagenic effect. Carrying out the Ames test, without or with "S 9 activation", permits a conclusion on whether a test substance is mutagenic in its starting form or only after metabolization.

Using this test system it was detected that the particle phase of tobacco smoke collected in solvents only has a mutagenic effect in the metabolized state (cf. Shigeaki Sato et al., "Mutagenicity of smoke condensates from cigarettes, cigars and pipe tobacco", Cancer Lett. 3, pp. 1–8, 1977).

It is regarded as confirmed that most substances with antimutagenic activity in the Ames test exert a protective effect in the human body or can contribute to the strengthening of the body's own defence system (cf. e.g. B. N. Ames, "Dietary Carcinogens and Anticarcinogens", SCIENCE, Vol. 221, pp. 1256–1264, 1983). The possible formation in the human body of toxic metabolic products from smoke constituents and the specific decrease in the mutagenic effect resulting from this by addition of antimutagens can be simulated in the Ames test.

Compared with the conventional products, the tobacco product proposed according to the invention has a greatly decreased risk potential, as the natural substances used exert their antioxidative properties on a multiplicity of undesired substances and display their actions at the site of metabolization.

The invention is illustrated in greater detail with the aid of the following examples and FIGS. 1 to 7.

EXAMPLE 1

To prepare for the Ames test, 20 cigarettes specified in greater detail below were mechanically smoked under the customary standard conditions (ISO 4387, puff volume 35 ml, puff duration 2 seconds and puff interval 58 seconds). The so-called particulate phase of the mainstream smoke (smoke condensate) was precipitated on a Cambridge glass fibre filter, dissolved using 20 ml of dimethyl sulphoxide and stored at −20° C. until use. The unventilated filter cigarettes (size 100×7.9 mm, rod 75 mm long, filter 25 mm long) had a rod weight of 945±10 mg (Virginia mixture), the smoked tobacco quantity was 800 mg. The cigarette paper of weight 48 mg had a porosity of 24 coresta, the filter weight, rounded, was 180 mg, the filter material consisted of commercially available cellulose acetate fibres (3.0 Y/35,000) and the hardener was triacetin (about 7%).

EXAMPLE 2

To determine the mutagenic effect, the Ames test (loc.cit.) was carried out in the "plate incorporation" version as described in the following.

0.1 ml of overnight culture of *Salmonella typhimurium*, strain TA 98, 0.05 ml of smoke condensate solution according to Example 1 diluted in steps and 0.5 ml of S 9 mix (activation system), consisting of 50 μl of supernatant obtained by centrifuging liver homogenate of Aroclor-pretreated rats at 9,000 g; 0.76 mg of glucose-6-phosphate; 1.57 mg of NADP; 0.81 mg of $MgCl_2.6\ H_2O$; 1.23 mg of KCl in phosphate buffer pH 7.4 were pipetted to 2 ml in each case of a soft agar temperature-controlled at 43° C. After thoroughly mixing for a short time, the test batches in Petri dishes were uniformly distributed on an agar which only allows the growth of the $his^+$-revertants. The petri dishes were subsequently incubated in the dark at 37° C. for 48 hours. After expiry of the incubation time, the colonies resulting from individual $his^+$-revertant bacteria were counted. The mutation frequency is the measure of the mutagenic activity.

From the results shown in Table 4 below, it is evident that the substances contained in the smoke condensate display their mutagenic effect only after their metabolization.

TABLE 4

Counted TA 98 colonies as a function of the amount of condensate employed (Average values from triplicate determinations)

| Amount of smoke condensate (μg per plate) | S9 activation | counted colonies | induced colonies |
|---|---|---|---|
| 0 | without | 41 | — |
| 120 | without | 43 | 2 |
| 240 | without | 40 | −1 |
| 360 | without | 35 | −6 |
| 0 | with | 50 | — |
| 120 | with | 216 | 166 |
| 240 | with | 441 | 391 |
| 360 | with | 581 | 531 |

EXAMPLE 3

The assessment of substances according to the invention with respect to their antimutagenic effects was carried out using the test system described in Example 2 by now adding additionally graduated doses of the substances concerned to the test batches containing the different amounts of condensate. It was ensured in this process that work was carried out in a concentration range which was not toxic for the bacteria.

The results of some of the substances according to the invention having an antimutagenic effect on smoke condensate are shown by way of example in FIGS. 1 to 6.

The results show that the mutation frequency caused by the harmful substances contained in the smoke condensate and thus the risk potential could be decisively decreased by the natural substances added.

EXAMPLE 4

The natural substances to be added differ significantly with respect to their melting and boiling points (cf. Table 1). In order to demonstrate that even substances added to the tobacco which cannot be distilled pass into the tobacco smoke, the following experiment was carried out:

Scopoletin (7-hydroxy-6-methoxycoumarin) having a melting point of 205° C., without boiling point, is contained in Virginia tobaccos in a concentration of about 300 ppm as a natural plant constituent. In order to detect the passage of added scopoletin into the mainstream smoke, three versions of experimental cigarettes based on the same cigarette lot as in Example 1 were prepared. In this process, the tobacco of 60 filter cigarettes according to Example 1 was blown out of these in a known manner by means of compressed air, collected and divided into three parts, two thirds were finished with the natural substance (the comparison only with ethanol) and added again by means of a commercially available tobacco filling machine for filter cigarette spills to 60 equal portions of the 3×20 filter spills which were blown out and divided into three lots, where, however, the rod weight of the filter cigarettes manufactured in this way was slightly decreased. In this process, the concentration of scopoletin in the tobacco was increased from originally 330 ppm to 630 ppm or 5,330 ppm by spraying an ethanolic solution of scopoletin on the cigarette tobacco. The cigarettes produced were smoked as described in Example 1, the smoke condensate collected being dissolved in methanol. The filter spill design data corresponded to those of Example 1, the rod weight was decreased to 930±20 mg and the amount of tobacco smoked was 785 mg.

The scopoletin was determined analytically by means of HPLC under the following conditions:

Column: Li Chro CART supersphere RP 8, 250–4 (Merck)
Eluent: Water/methanol/acetic acid—85:13:2
Flow rate: 1.2 ml/min
Isocratic operation at 45° C.
Detector at 340 nm
Injection volume: 10 μl sample The experimental results obtained are compiled in Table 5 which follows:

TABLE 5

Passage of scopoletin into the mainstream smoke

| Cigarette version | Scopoletin: Concentration in the tobacco (ppm) | Amount in the smoked tobacco (μg) | Amount found in the mainstream smoke (μg) | Proportion of the amount of tobacco smoked (%) |
|---|---|---|---|---|
| Comparison | 330 | 259.1 | 28.2 | 10.9 |
| Experimental mixture 1 | 630 | 494.6 | 47.6 | 9.6 |
| Experimental mixture 2 | 5,330 | 4,184.1 | 331.1 | 6.2 |

Amount of tobacco smoked: 785 mg per cigarette

The experiments with scopoletin, as a representative of the non-volatile substances having an antimutagenic effect, show that the treatment of the tobacco with 300 or 5,000 ppm has led to a substance transfer of 9.6 or 6.2% respectively into the mainstream smoke.

EXAMPLE 5

The results of the experiment described below show that the substances having an antioxidative effect passing into the smoke from mixtures of cut tobacco with cloves or cinnamon sticks respectively, and also the treatment with pure eugenol, decrease the mutagenic effect of the smoke condensate thus resulting.

Five versions of filter cigarettes which differ in the composition of the final mixture according to Table 6 and have the same tobacco base mixture were prepared in the same format and same cigarette weight (940 mg). The cloves or cinnamon sticks employed were moistened with steam, rolled and cut before mixing with tobacco. The addition of the eugenol was carried out in 20% strength ethanol solution, the alcohol being quantitatively evaporated after the treatment.

TABLE 6

Cut tobacco containing additions of cloves, cinnamon sticks and eugenol

| Mixture | Composition of the cut tobacco mixture | | | |
|---|---|---|---|---|
| | Tobacco (% wt.)[2] | Cloves (% wt.)[2] | Cinnamon sticks (% wt.)[2] | pure eugenol added (% wt.)[2] |
| 1 | 70 | 30 | — | — |
| 2 | 70 | — | 30 | — |
| 3 | 70 | 15 | 15 | — |
| 4 | 94.9 | — | — | 5.1[1] |
| 5 | 100 | — | — | — |

[1]The amount of eugenol added here is equivalent to the amount of eugenol contained in the cloves of mixture 1.
[2]% wt. = percentage by weight, based on the dry weight.

The experimental cigarettes were smoked under standard conditions (see Example 1). The smoke condensate solutions resulting from this were investigated using the Ames test according to Example 2, namely in the embodiment "with S9 activation". To assess the mutagenicity, the same amounts of smoke condensate were employed and the results were based on the untreated comparison=100%.

Figure 7:
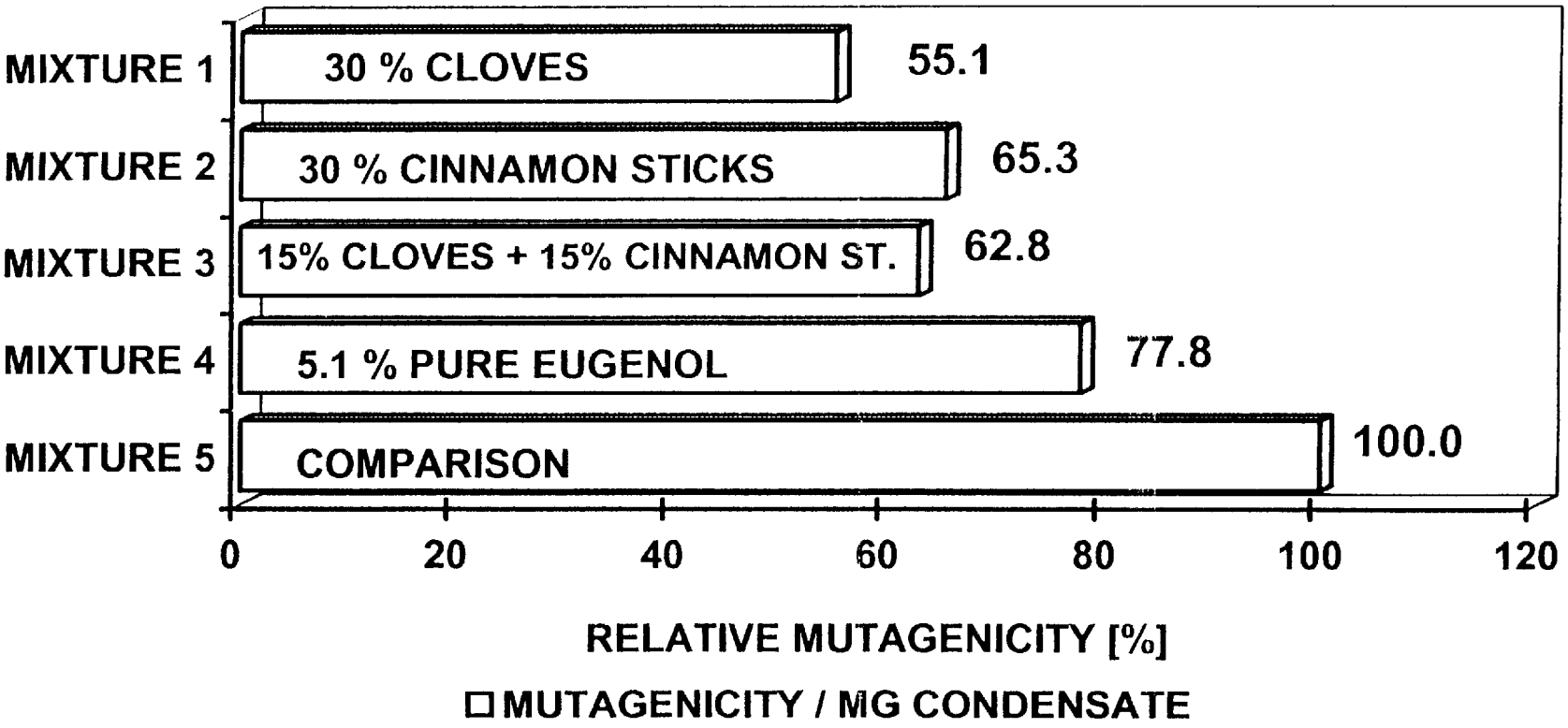
FIG. 7 is a bar graph representation of the comparison of the mutagenic effect of the same amount of smoke condensate of different experimental cigarettes.

The experimental results are represented diagrammatically in FIG. 7. The mutagenicity of the smoke condensate of mixture 1 was decreased to 55.5% of the effect of the comparison, which can be explained by the amount of eugenol contained in the cloves. The cloves employed had a eugenol content of 17.0%. In contrast to this, the surprising decrease in the mutagenicity of the smoke condensate of mixture 2 to 65.3% cannot be explained on its own by the amounts of cinnamaldehyde and eugenol contained.

We claim:

1. Smokable product comprising one or more combustible products selected from the group consisting of tobacco and other smokable materials, further comprising a combination of additives which have an anti-oxidative and antimutagenic effect, the additives comprising:

(a) one or more vitamins selected from the group consisting of retinol, α-tocopherol, ascorbic acid, β-carotene, their precursors and derivatives thereof; and (b) one or more natural substances of plant origin having antimutagenic and aromatizing properties, selected from the group consisting of ethylvanillin, cinnamaldehyde, anisaldehyde, coumarin, 6-methylcoumarin, eugenol, jasmine aldehyde, anethole, p-anisylacetone, limonene, cinnamon, cinnamon extract, precursors thereof and derivatives thereof;

wherein the additives are present in an amount of at least 1.0% by weight of the total weight of the smokable product, such that the additives impart an antimutagenic effect to the metabolic products formed from smoke constituents directly at the site of metabolism in the human body when the smokable product is burned and inhaled.

2. Smokable product according to claim 1, wherein the vitamin is ascorbic acid, and the ascorbic acid is present in a form selected from the group consisting of ascorbic acid palmitate and ascorbigen.

3. Smokable product according to claim 1, wherein the vitamins are selected from the group consisting of β-carotene, retinol, α-tocopherol and derivatives thereof.

4. Smokable product according to claim 1, wherein the additives are contained individually or in combination.

5. Smokable product according to claim 1, wherein the smokable product contains up to 25% by weight of the additives.

6. Smokable product according to claim 5, wherein the smokable product contains 1 to 5% by weight of the additives.

7. Smokable product according to claim 1, wherein the smokable product is selected from the group consisting of a filtered cigarette, a filtered cigarillo, a filtered tobacco cartridge, an unfiltered cigarette, an unfiltered cigarillo and an unfiltered tobacco cartridge.

8. Smokable product according to claim 7, wherein the smokable product is smoking tobacco selected from the group consisting of fine-cut tobacco and pipe tobacco.

9. Smokable product according to claim 7, wherein the smokable product further comprises a filter, the filter contains up to 50% by weight of the additives.

10. Smokable product according to claim 9, wherein the filter contains 1 to 20% by weight of the additives.

11. Smokable product according to claim 9, wherein the filter is selected from the group consisting of a chamber filter with filter ventilation, a commercially available cellulose acetate fibre filter with filter ventilation, a commercially available cellulose random fibre web filter with filter ventilation, a chamber filter without filter ventilation, a commercially available cellulose acetate fibre filter without filter ventilation, and a commercially available cellulose random fibre web filter without filter ventilation.

12. Smokable product according to claim 9, wherein the filter is a multiple filter, comprising at least a double filter, having a higher draw resistance on the rod side and a lower draw resistance on the mouth side with or without filter ventilation and has a total filter efficiency of 80–99%.

13. Smokable product according to claim 9 further comprising a cigarette paper, wherein the cigarette paper contains up to 50% by weight of the additives.

14. Smokable product according to claim 1, wherein the tobacco is selected from the group consisting of mixtures of lamina tobaccos and lamina tobacco mixed with reconstituted tobacco.

15. Smokable product according to claim 1, wherein the combustible products contain up to 25% by weight of the additives.

16. Smokable product according to claim 1, wherein the combustible products are a tobacco-free mixture of plant material which is selected from the group consisting of coltsfoot, peppermint, stinging nettle, ripple-seed plantain, crispleaf mint, lavender, thyme, sweet cherry leaves, sour cherry leaves, knotweed leaves, rose leaves, pimento leaves, cinnamon bark, and combinations thereof.

17. Smokable product according to claim 16, wherein the combustible products are derived from cinnamon bark.

18. Smokable product according to claim 1, wherein the combustible products are a combination of tobacco mixture and tobacco-free mixture.

19. Process for the preparation of a smokable product comprising:

replacing at least partially the substances customarily used as hardeners for the cellulose acetate fibres forming the later filter by one or more of the additives according to claim 1.

20. Process according to claim 19, wherein the step of at least partially replacing the substances customarily used as hardeners by one or more of the additives further comprises the use of eugenol on its own or as a solution containing one or more additives selected from the group consisting of ethylvanillin, cinnamaldehyde, anisaldehyde, coumarin, 6-methylcoumarin, jasmine aldehyde, anethole, p-anisylacetone, limonene, cinnamon, cinnamon extract, α-tocopherol acetate, tocopherol succinate, retinol and retinol palmitate.

21. Smokable product according to claim 1, wherein the smokable product contains 5% by weight of the additives.

* * * * *